United States Patent [19]

Nieda et al.

[11] 4,342,142

[45] Aug. 3, 1982

[54] METHOD FOR MANUFACTURING SEALED-BEAM TYPE ELECTRIC BULB

[75] Inventors: Yasuhiro Nieda, Yokosuka; Kiyokazu Honda, Zushi, both of Japan

[73] Assignee: Tokyo Shibaura Denki Kabushiki Kaisha, Kawasaki, Japan

[21] Appl. No.: 186,623

[22] Filed: Sep. 12, 1980

[30] Foreign Application Priority Data

Sep. 17, 1979 [JP] Japan ..... 54-117904

[51] Int. Cl.[3] ..... H01J 9/18

[52] U.S. Cl. ..... 29/25.13

[58] Field of Search ..... 29/25.13; 313/113

[56] References Cited

U.S. PATENT DOCUMENTS 2,317,031 4/1943 Cotman et al. ..... 29/25.13

FOREIGN PATENT DOCUMENTS 510781 3/1955 Canada ..... 313/113

39-19470 7/1964 Japan .

47-40136 12/1972 Japan .

*Primary Examiner*—Howard N. Goldberg

*Assistant Examiner*—Fred A. Silverberg

*Attorney, Agent, or Firm*—Cushman, Darby & Cushman

[57] ABSTRACT

A method of manufacturing a sealed-beam type electric bulb comprises steps of inserting external lead wires of a halogen lamp having a filament inside into two through holes formed in a plastic base plate, filling said through holes with a flowable adhesive, shifting said halogen lamp so that said filament is positioned at a predetermined position, curing said adhesive to bond said external lead wires to said plastic base plate after shifting said halogen lamp thereby fixing the halogen lamp to said plastic base plate and inserting said plastic base plate with said halogen lamp mounted thereon into an opening formed at the rear end portion of a plastic reflector, and fixing said plastic base plate at the rear end of said reflector, thereby positioning said halogen lamp within said reflector.

9 Claims, 4 Drawing Figures

METHOD FOR MANUFACTURING SEALED-BEAM TYPE ELECTRIC BULB

The present invention relates to a method for manufacturing a sealed-beam type electric bulb comprising a tungsten halogen lamp built in an air-tight container, particularly to a method for manufacturing a small sealed-beam type electric bulb suitable for the head lamp of an automobile.

Sealed-beam type electric bulbs of this type have the advantages of high efficiency, long service life and high-power application, compared to bulbs in which tungsten filaments are sealed directly in an air-tight container. However, the former has drawbacks in that, when installing a tungsten halogen lamp in an air-tight container complicated work is involved in mounting the tungsten filaments of tungsten halogen lamp at the focus or at a spot a predetermined precise distance from the focus of the reflector formed on the container inner surface, and the precision of mounting is not high. The reason for this is that it is difficult to precisely fix the relative positions of the tungsten halogen lamp bulb external surface, the filaments and the external lead wires for each tungsten halogen lamp bulb for manufacturing each sealed-beam electric bulb with precision. These tungsten halogen lamps thus have to be installed in air-tight containers under visual checking of the filament position for each bulb. The external bulb or air-tight container of a conventional sealed beam type electric bulb comprises a borosilicate glass reflector coated with a reflecting film on its inner surface, and a lens formed with the same glass material. A ferrule made of an Fe-Ni alloy is attached to the reflector. To install a tungsten halogen lamp bulb in this air-tight container while each external lead wire for the tungsten halogen lamp bulb is inserted in the ferrule, the bulb is shifted while visually checking the position of the lamp filaments; when the predetermined filament position is obtained, the external lead wires are soldered to the ferrule. This soldering work is complicated and has the danger of a slight shift in the external wire position relative to the ferrule, i.e. the position of the tungsten halogen lamp upon soldering. Therefore, the workability and yield of the manufacture of such sealed-beam type electric bulbs are poor.

It is, therefore, an object of the present invention to provide a method for manufacturing sealed-beam type electric bulbs which are compact in size, light in weight and suitable for automobile head lamps, with high manufacturing workability and yield.

Figure 1:
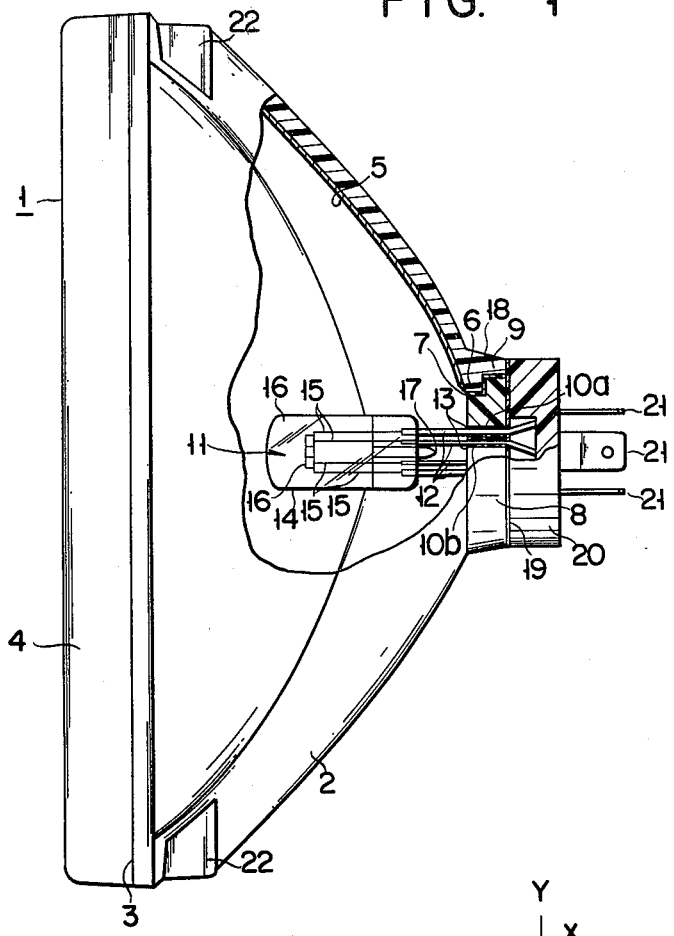
Figure 2:
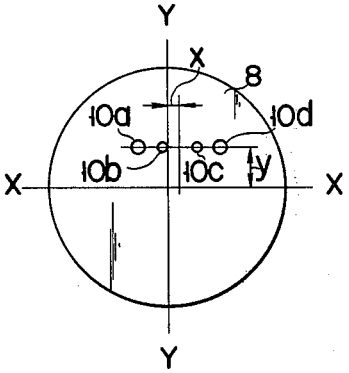
Figure 3:
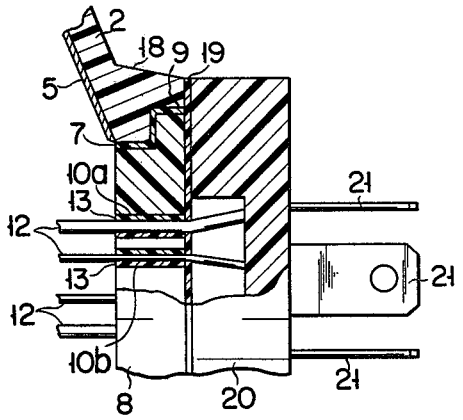
Figure 4:
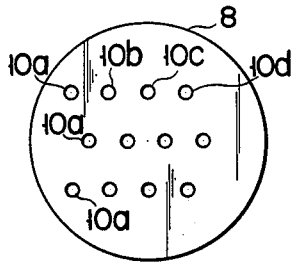

This invention can be more fully understood from the following detailed description when taken in conjunction with the accompanying drawing, in which:

FIGS. 1 to 3 illustrate a sealed-beam type electric bulb manufactured by the method of one embodiment of the present invention wherein FIG. 1. is a partially cutaway side view, FIG. 2 is a plan view of a plastic base plate, and FIG. 3 is a partially enlarged view of FIG. 1; and FIG. 4 is a plan view of a modified plastic base plate.

The method for manufacturing a sealed-beam type electric bulb according to an embodiment of the present invention will be described below with reference to the attached drawing.

In FIG. 1, the numeral 1 denotes an air-tight container which has a rectangular opening 3 in front, a funnel-shaped reflector 2 which is tapered toward the rear, and a lens 4 mounted in the opening 3 so as to close the opening. The reflector 2 is made of a plastic material, and a reflecting film 5 of a metal such as aluminum is formed on the inner surface of the reflector 2. The rear portion 6 of this reflector 2 is formed in a flat plate form substantially parallel to the front surface and has a circular through hole 7 which has a step on its inner circumference. Into this through hole 7, a disk-shaped plastic base plate 8 which has a step on its outer circumference corresponding to the step of the through hole 7 is inserted closely and bonded to the rear portion 6 by means of an adhesive layer 9 interposed between its outer circumference and the inner circumference of the through hole 7. The plastic base plate 8 has four small through holes 10*a*, 10*b*, 10*c* and 10*d*, as illustrated in FIG. 2. In the case where a tungsten halogen lamp bulb having two filaments is used as the light source 11, its four external lead wires 12 are respectively inserted in these small through holes and each external lead wire 12 is bonded by an adhesive 13 filled into each small through hole. When a tungsten halogen lamp bulb having a single filament is employed as the light source 11, its two external lead wires are respectively inserted in two predetermined holes among the small through holes 10*a* to 10*d*, and bonded by the adhesive in the same manner as described. The rest of the holes are closed with the adhesive. The tungsten halogen lamp bulb 11 comprises an air-tight bulb 14 consisting of silica glass; internal lead wires 15 disposed inside the air-tight bulb 14; a tungsten filament 16 which connects with one end of each of the internal lead wires 15; a sealing end portion 17 for evacuation of the bulb 14, for filling a halogen gas into the bulb, and for sealing the bulb thereafter; and the external lead wires 12 mentioned above, one end of each being connected to th other end of a corresponding internal lead wire 15 and leading out of the bulb through the sealing end portion 17. A base 20 is attached to the external rear surface of the reflector 2 and the external surface of the plastic base plate 8 with an adhesive 19 and the base 20 is provided with lugs 21. In a hole (not shown) of the base 20 are located the terminal ends of the external lead wires 12 which extend through the small through holes of the base plate 8. These terminal ends are soldered to the lugs 21 at this location. In FIG. 1, numeral 22 denotes a plurality of sealing bosses for sealed-beam type electric bulb, formed as an integral part of the reflector 2 near the opening 3.

The four small through holes 10*a* to 10*d* of the plastic base plate 8 are arranged as shown in FIG. 2. In other words, the four small through holes 10*a* to 10*d* are spaced from the horizontal axis (X—X axis) that includes the center of the base plate 8 by a predetermined distance (y). The holes 10*a* and 10*b* are asymmetrically separated with respect to the vertical axis (Y—Y axis) from the holes 10*c* and 10*d*, and the middle point between the hole 10*b* and the hole 10*c* is spaced from the Y—Y axis by a predetermined distance (x). The plastic base plate 8 which has such through holes can be used to direct the beams upward or downward, or to the left or right by locating the holes above or below the X—X axis or by shifting the holes to the right or the left with respect to the Y—Y axis.

In the above embodiment, a plastic base plate with four small through holes for the lead wires is used; however, the scope of application becomes wider and the positioning becomes more precise with a greater number of small through holes. For example, if three groups, each containing a linear arrangement of four small through holes 10*a* to 10*d*, are provided at a slight shifted position along the direction of the linear arrangement, rough positioning is possible by suitably selecting holes for the tungsten halogen lamp bulb to be used. Needless to say, the remaining holes of the base plate 8 must be filled with the adhesive to close them.

Next, the manufacturing method of a sealed-beam type electric bulb of the above construction will be described. The external lead wires 12 of the tungsten halogen lamp bulb 11 are inserted from the inside through each of the small through holes 10*a* to 10*d* of the plastic base plate 8. Then a flowable adhesive 13 consisting of an organic adhesive is filled into these small through holes and around the lead wire 12. Before this adhesive solidifies, three-dimensional positioning of the tungsten filament 16 of the tungsten halogen lamp bulb 11 is carried out using the plastic base plate 8 as the reference. This positioning method may be realized by placing flat mirrors in the axial and transverse directions of the tungsten filament 16, respectively, and shifting the tungsten halogen lamp bulb so that the position at which the image of the filament 16 is located is at the reference position in the mirrors. Thus, the tungsten halogen lamp bulb 11 is positioned at the predetermined position, the adhesive 13 is solidified, and the external lead wires are bonded to the plastic base plate 8. Then the plastic base plate 8 is inserted into the through hole 7 of the reflector 2. While both steps are mutually engaged, the adhesive layer 9 between the two surfaces is solidified to bond the plastic base plate 8 to the reflector 2. The positioning of the tungsten halogen lamp bulb relative to the reflector 2 in this step may either be unnecessary by preliminary fixing of the dimensions of the plastic base plate 8 and the through hole 7, or may be realized by shifting the base plate 8 in the axial direction and/or rotating it for fine adjustment when necessary. Then the lens 4 is fit in the opening 3 of the reflector 2, and these are bonded to each other by means of an adhesive. The external lead wires 12 which lead out from the plastic base plate 8 are introduced into the hole of the base 20, and the base 20 is bonded to the reflector 2 and the plastic base plate 8 by an adhesive. The external lead wires are soldered to the lugs 21 of the base 20 to complete a sealed-beam type electric bulb.

In the above-described manufacturing method of a sealed-beam type electric bulb, a plastic base plate with small through holes formed at predetermined places in advance is prepared. While the external lead wires of the tungsten halogen lamp bulb are inserted into the small through holes of the base plate, the filaments of the tungsten halogen lamp are positioned and the adhesive preliminary filled into said small through holes is soldified. This permits easy positioning and eliminates the fear that the external lead wires will shift while the adhesive solidifies. The positioning can be made easier, needless to say, if the number of small through holes of the plastic base plate is increased, only the necessary small through holes being used and the rest being filled. Because the plastic base plate to which the tungsten halogen lamp bulb is thus mounted easily bonded to the reflector by means of adhesive, fine positioning adjustment is also possible in this step if necessary. The base plate that supports the reflector and the tungsten halogen lamp bulb is made of a plastic material so that the whole setup is light in weight and its manufacture is simple.

As the material for the reflector and base plate, a plastic material having good heat resistance and high hardness is desirable. The lens may be made of glass, but when formed with plastics as in this embodiment, better light-transmission and a dust-free tendency are desirable in addition to the above characteristics. As a plastic material that satisfies these conditions, "LEXAN," a polycarbonate resin of General Electric Co., is known.

If an aluminum or other metal reflecting film is formed on the inner surface of the plastic base plate, it causes not only a danger of short circuiting the external lead wires, but this reflecting film also reflects irregularly, disturbing the desired reflection patter. Therefore, a reflecting film is not required for the inner surface of the plastic base plate.

As the adhesive used for bonding the external lead wires to the plastic base plate, and the plastic base plate to the reflector, epoxy-based adhesive is suitable in view of air-tightness and adhesion, a very suitable kind being CIBA-CEIGY's ARALDITE AV 138.

In the case of bonding the external lead wires of the tungsten halogen lamp bulb to the plastic base plate, it is helpful to consider the linear thermal expansion coefficients of both materials for better adhesion. Specifically, when the plastic base plate is made of a material having a linear thermal expansion coefficient greater than that of the external lead wires, heating e.g. at a temperature above 60° C., causes a space to expand between the circumferences of the small through holes of the plastic base plate and the external lead wires. By filling the holes with the adhesive in this state, followed by curing and cooling, the plastic base plate squeezes the cured adhesive, pressing it toward the direction of the external lead wires. Thus, the adhesive layer is tightly held between the base plate and the wire. The plastic base plate of the above-mentioned polycarbonate resin has a linear thermal expansion coefficient of $6\times10^{-5}$ cm/cm/°C. at ordinary temperatures; when using nickel for the external lead wires, its linear thermal expansion coefficient is $1.28\times10^{-5}$ cm/cm/°C. at ordinary temperature; and, when using nickel-plated iron, the linear thermal expansion coefficient of iron is $1.2\times10^{-5}$ cm/cm/°C. at ordinary temperature. Thus, these indicate suitable combinations. Furthermore, the linear thermal expansion coefficient of the plastic base plate increases remarkably at temperatures above 60° C., and is capable of reaching $10^{-3}$ cm/cm/°C. when heated to a high temperature, leading to excellent bonding of high adhesion. When carrying out the bonding at a temperature below 60° C., since the difference in the linear thermal expansion coefficients is as small as about $10^{-5}$ cm/cm/°C., this phenomenon is difficult to obtain, leading to bonding due to mere adhesion by the adhesive, and excellent bonding may not be obtained.

In the description of the above embodiment, the adhesive is filled after inserting the external lead wires into the small through holes of the plastic base plate; however, the external lead wires may be inserted into small through holes filled with the adhesive in advance.

The bonding between the plastic base plate and the reflector may be realized without an adhesive, but by fusion bonding e.g., by high-frequency heating or ultrasonic heating.

In the description, the plastic reflector has a rectangular opening, but is not limited to a rectangular opening. A circular opening, for example, may be used. Furthermore, the shape of the plastic base plate is not limited to a disk shape.

What we claim is:

1. A method of manufacturing a sealed-beam type electric bulb comprising:

a first step of inserting external lead wires of a light source having a filament inside into a plurality of through holes formed in a plastic base plate, and filling said through holes with a flowable adhesive;

a second step of shifting said light source so that said filament is positioned at a predetermined position;

a third step of curing said adhesive to bond said external lead wires to said plastic base plate after shifting said light source, thereby fixing the light source to said plastic base plate;

a fourth step of inserting said plastic base plate with said light source mounted thereon into an opening formed at the rear end portion of a plastic reflector with a reflecting inner surface, and fixing said plastic base plate at the rear end of said reflector, thereby positioning said light source within said reflector; and a fifth step of attaching a lens at the front end of said reflector so as to close an opening at the front end of said reflector.

2. A method of manufacturing a sealed-beam type electric bulb according to claim 1 wherein said first step is a step of inserting a pair of external lead wires of the light source inside into two predetermined through holes of at least two through holes formed in said plastic base plate, and filling said two holes with said flowable adhesive.

3. A method of manufacturing a sealed-beam type electric bulb according to claim 2 wherein the step of filling the flowable adhesive in the through holes in said first step is realized after inserting said external lead wires.

4. A method of manufacturing a sealed-beam type electric bulb according to claim 3 wherein said through holes are formed in an asymmetric arrangement relative to the central axis of said plastic base plate.

5. A method of manufacturing a sealed-beam type electric bulb accoring to claim 4 wherein the opening formed at the rear end portion of said plastic reflector has a stepped portion, and said plastic base plate has on its circumference a stepped portion corresponding to said stepped portion.

6. A method of manufacturing a sealed-beam type electric bulb according to claim 5 wherein said plastic reflector and said plastic base plate are bonded together with an adhesive.

7. A method of manufacturing a sealed-beam type electric bulb according to claim 1 wherein said first step is a step of inserting two pairs of external lead wires of the light source having two filaments inside into four predetermined through holes of at least four through holes formed in said plastic base plate, and filling said four holes with a flowable adhesive.

8. A method of manufacturing a sealed-beam type electric bulb according to claim 1 wherein said lens is made of a plastic material.

9. A method of manufacturing a sealed-beam type electric bulb according to any one of the preceding claims wherein said plastic base plate is made of a material having a linear thermal expansion coefficient greater than that of said external lead wire material.

* * * * *